US007011069B2

(12) United States Patent
Ono et al.

(10) Patent No.: US 7,011,069 B2
(45) Date of Patent: Mar. 14, 2006

(54) OIL SUPPLY SYSTEM FOR ENGINE

(75) Inventors: Hisashi Ono, Toyota (JP); Hiroshi Kato, Okazaki (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/978,038

(22) Filed: Nov. 1, 2004

(65) Prior Publication Data

US 2005/0098385 A1 May 12, 2005

(30) Foreign Application Priority Data

Nov. 6, 2003 (JP) ..... 2003-377530

(51) Int. Cl.
*F01M 1/00* (2006.01)

(52) U.S. Cl. ..... 123/196 R

(58) Field of Classification Search ..... 123/196 R, 123/198 C; 417/282; 184/6.5
See application file for complete search history.

(56) References Cited

U.S. PATENT DOCUMENTS

| | | | | |
|---|---|---|---|---|
| 3,067,689 A | | 12/1962 | Hause | |
| 5,547,349 A | * | 8/1996 | Kimura et al. | 417/282 |
| 5,722,815 A | | 3/1998 | Cozens | |

FOREIGN PATENT DOCUMENTS

| | | |
|---|---|---|
| DE | 1 145 929 | 7/1955 |
| JP | 2598994 | 12/1993 |
| JP | 8-114186 | 8/1995 |
| JP | 8-210116 | 10/1995 |

* cited by examiner

*Primary Examiner*—Henry C. Yuen
*Assistant Examiner*—Hyder Ali
(74) *Attorney, Agent, or Firm*—Reed Smith LLP; Stanley P. Fisher, Esq.; Juan Carlos A. Marquez, Esq.

(57) ABSTRACT

An oil supply system for an engine includes a pump body provided with a first outlet port and a second outlet port. The oil supply system further includes a hydraulic-oil-delivery passage, a first oil passage, a second oil passage and a return hydraulic passage. The valve body divides a hydraulic-oil receiving portion for receiving the hydraulic oil in the hydraulic-pressure control valve chamber into a first valve chamber and a second valve chamber. When the hydraulic pressure oil delivered to the hydraulic-oil-delivery passage is in a predetermined value, the hydraulic oil discharged out of the second outlet port is delivered to the hydraulic-oil-delivery passage via the first valve chamber. When the hydraulic pressure delivered to the hydraulic-oil-delivery passage exceeds the predetermined value, the hydraulic oil discharged out of the second outlet port is delivered to the hydraulic-oil-delivery passage via the second valve chamber.

10 Claims, 6 Drawing Sheets

OIL SUPPLY SYSTEM FOR ENGINE

CROSS REFERENCE TO RELATED APPLICATIONS

This application is based on and claims priority under 35 U.S.C. § 119 with respect to Japanese Patent Application 2003-377530, filed on Nov. 6, 2003, the entire content of which is incorporated herein by reference.

FIELD OF THE INVENTION

This invention generally relates to an oil supply system for an engine. More specifically, this invention relates to an oil supply system for an engine provided with a pump body including an inlet port suctioning hydraulic oil in response to the rotation of a rotor driven by synchronizing with a crankshaft and first and second outlet ports discharging the hydraulic oil in response to the rotation of the rotor. The oil supply system for the engine is further provided with a hydraulic-oil-delivery passage for delivering the hydraulic oil to a hydraulic-oil receiving unit, a first oil passage for delivering the hydraulic oil discharged out of at least the first outlet port to the hydraulic-oil-delivery passage and a second oil passage for delivering the hydraulic oil discharged out of the second outlet port to the hydraulic-oil-delivery passage. Furthermore, the oil supply system for the engine is further provided with a return hydraulic passage returning the hydraulic oil discharged out of a hydraulic-pressure control valve including a valve which is moved in response to hydraulic pressure of the hydraulic oil delivered to the hydraulic-oil-delivery passage, to at least either the inlet port or an oil pan.

BACKGROUND

In an engine for vehicles, an oil pump (i.e., an oil supply system) delivering the hydraulic oil to be used for lubrication of the engine to each portion of the engine has a variable discharge volume structure variably adjusting discharging pressure in response to the rotation of the engine. The above mentioned oil supply system is shown in JPH08 (1996)-114186A and JP2598994Y.

For example, the oil supply system described in JPH08 (1996)-114186A is provided with an oil pump including the first outlet port and the second outlet port discharging the hydraulic oil in response to the rotation of the rotor and the hydraulic-oil-delivery passage delivering the hydraulic oil to the hydraulic-oil receiving unit. The oil supply system is further provided with the first oil passage delivering the hydraulic oil discharged out of the first outlet port to the hydraulic-oil-delivery passage, the second oil passage delivering the hydraulic oil discharged out of the second outlet port to the hydraulic-oil-delivery passage and the return oil passage returning the hydraulic oil discharged out of the second outlet port to the oil pump. Furthermore, the oil supply system includes a control valve including the valve operable in response to the hydraulic pressure of the hydraulic oil of the first oil passage.

When the hydraulic pressure of the first oil passage is lower than a predetermined value, this control valve delivers the hydraulic oil via both the first oil passage and the second oil passage to the hydraulic-oil-delivery passage (i.e., a first mode). When the hydraulic pressure of the first oil passage is higher than the predetermined value, the control valve prevents merging of the hydraulic oil flow in the first and the second oil passages and allows the hydraulic-oil in the first oil passage to be delivered to the hydraulic-oil-delivery passage, and forces the hydraulic oil in the second oil passage to be returned to the return oil passage (i.e., a second mode). Accordingly, the oil supply system is capable of switching from the first mode to the second mode or vice versa.

As shown in FIG. 9, while the rotational speed of the rotor in the engine is in a low speed area lower than a predetermined speed (N1) (i.e., when the hydraulic pressure of the first oil passage is lower than the predetermined value), the discharged amount of the hydraulic oil discharged out of the oil supply system has a characteristic similar to a dotted line "a". In other words, a supply amount of the hydraulic oil delivered to the hydraulic-oil-delivery passage is a total amount of the discharging amount of the first outlet port (i.e., a main outlet port) and the discharging amount of the second outlet port (i.e., a sub-outlet port) (i.e., the first mode).

In a first medium speed area starting from a point "Y" exceeding the predetermined speed (N1), the valve slides within the control valve according to the increase of the hydraulic pressure in the first oil passage, and a passage for returning to the return oil passage is open for communication. A rate of the increase of the discharging amount relative to the increase of the rotational speed becomes smaller (see a solid line "Y-Z" shown in FIG. 9).

When the rotational speed of the rotor further increases and reaches at a point "Z" which is a second medium speed area, the valve further slides in the control valve to prevent merging of the hydraulic oil in the first oil passage and the second oil passage (i.e., the second mode). In this case, the discharging amount of the hydraulic oil discharged out of the oil supply system is on a chain line "b" in FIG. 9 which shows the discharging amount at the first outlet port. In a high-speed area, thereafter, the discharging amount has an approximately similar characteristic to the chain line "b". That is, the supply amount of the hydraulic oil delivered to the hydraulic-oil-delivery passage becomes approximately equal to the discharging amount of the first outlet port.

In the first mode, even when the rotational speed of the rotor is low, the required hydraulic pressure delivered to the hydraulic-oil receiving unit is secured by merging of the hydraulic oil in the first oil passage and the hydraulic oil in the second oil passage.

On the other hand, when the discharging amount discharged out of the first outlet port increases in response to the increase of the rotational speed of the rotor and the required hydraulic pressure is secured by the first oil passage only, the first mode is shifted to the second mode wherein the extra hydraulic oil discharged out of the second outlet port in the second oil passage is returned to the inlet port side via the return oil passage. As mentioned above, if the extra hydraulic oil is returned to the return oil passage from the second oil passage without delivering to the hydraulic-oil-delivery passage, the extra hydraulic oil would not be affected by a large hydraulic pressure. Accordingly, when the required hydraulic pressure is secured by the first oil passage only, an additional work in the oil pump device can be reduced or avoided and the driving horsepower of the oil supply system can be reduced.

According to the oil supply system disclosed in JPH08 (1996)-114186A, when an oil temperature of the hydraulic oil raises e.g., up to 130 degrees Celsius by increasing of the rotational speed of the rotor after the engine has been started, viscosity of the hydraulic oil becomes less and the hydraulic oil can easily be supplied to the spaces between each portion in the hydraulic-oil receiving unit. This will cause the increase of so-called oil leakage.

As shown in FIG. 9, when the rotational speed of the rotor in the engine increases and reaches at a point "Z", the discharging amount of the hydraulic oil discharged out of the oil supply system indicated by a solid line in FIG. 9 has an approximately similar characteristic performance to the chine line "b" showing the discharging amount of the first outlet port. The difference between the chine line "b" and the solid line arises due to the oil leakage.

That is, viscosity of the hydraulic oil becomes more less in response to further increase of the rotational speed of the rotor, and an oil leakage phenomenon may occur frequently. In order to prevent this, however, there is a problem that it is difficult to keep the required oil amount for keeping the hydraulic pressure for a jet for a piston and a crank journal in the hydraulic-oil receiving unit.

Especially, in the jet for the piston, when the rotor rotates at a high speed, it is required to supply much hydraulic oil to the piston immediately. For that purpose, when the rotor rotates at high speed, it is preferable that the required oil amount corresponds to the discharging amount of the hydraulic oil discharged out of the oil supply system i.e., the total discharging amount (shown by a dotted line "a" in FIG. 9) adding up the discharging amount of the first and second outlet ports.

A need exists for providing an improved oil supply system capable of securing sufficiently a required oil amount for delivering to the hydraulic-oil receiving unit to, even when the engine rotates at high speed.

SUMMARY OF THE INVENTION

According to an aspect of a present invention, an oil supply system for an engine includes a pump body including an inlet port for suctioning a hydraulic oil in response to the rotation of a rotor driven by synchronizing with a crankshaft, a first outlet port for discharging the hydraulic oil and a second outlet port for discharging the hydraulic oil in response to the rotation of the rotor and a hydraulic-oil-delivery passage for delivering the hydraulic oil to a hydraulic-oil receiving unit. The oil supply system for the engine further includes a first oil passage for delivering the hydraulic oil discharged out of the first outlet port to the hydraulic-oil-delivery passage, a second oil passage for delivering the hydraulic oil discharged out of the second outlet port to the hydraulic-oil-delivery passage and a return hydraulic passage for returning the hydraulic oil discharged out of a hydraulic-pressure control valve including a valve body which is moved in response to the hydraulic pressure delivered to the hydraulic-oil-delivery passage, to at least either the inlet port or an oil pan. The valve body divides a hydraulic-oil receiving portion for receiving the hydraulic oil in the hydraulic-pressure control valve chamber into a first valve chamber and a second valve chamber. When the hydraulic pressure oil delivered to the hydraulic-oil-delivery passage is in a predetermined value, the hydraulic oil discharged out of the second outlet port is delivered to the hydraulic-oil-delivery passage via the first valve chamber. Further when the hydraulic pressure delivered to the hydraulic-oil-delivery passage exceeds the predetermined value, the hydraulic oil discharged out of the second outlet port is delivered to the hydraulic-oil-delivery passage via the second valve chamber.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
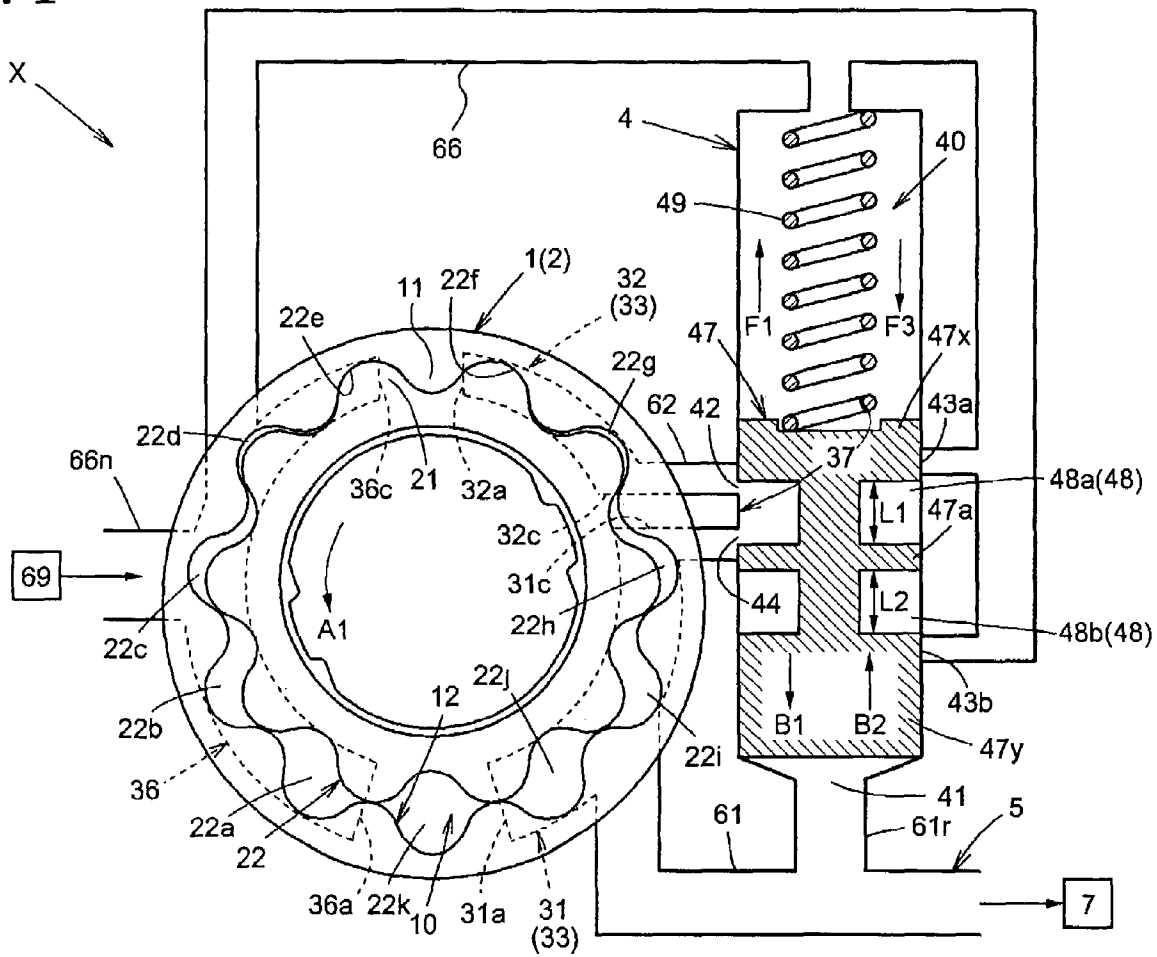
FIG. 1 is a conceptual arrangement of an oil supply system of the present invention.
Figure 2:
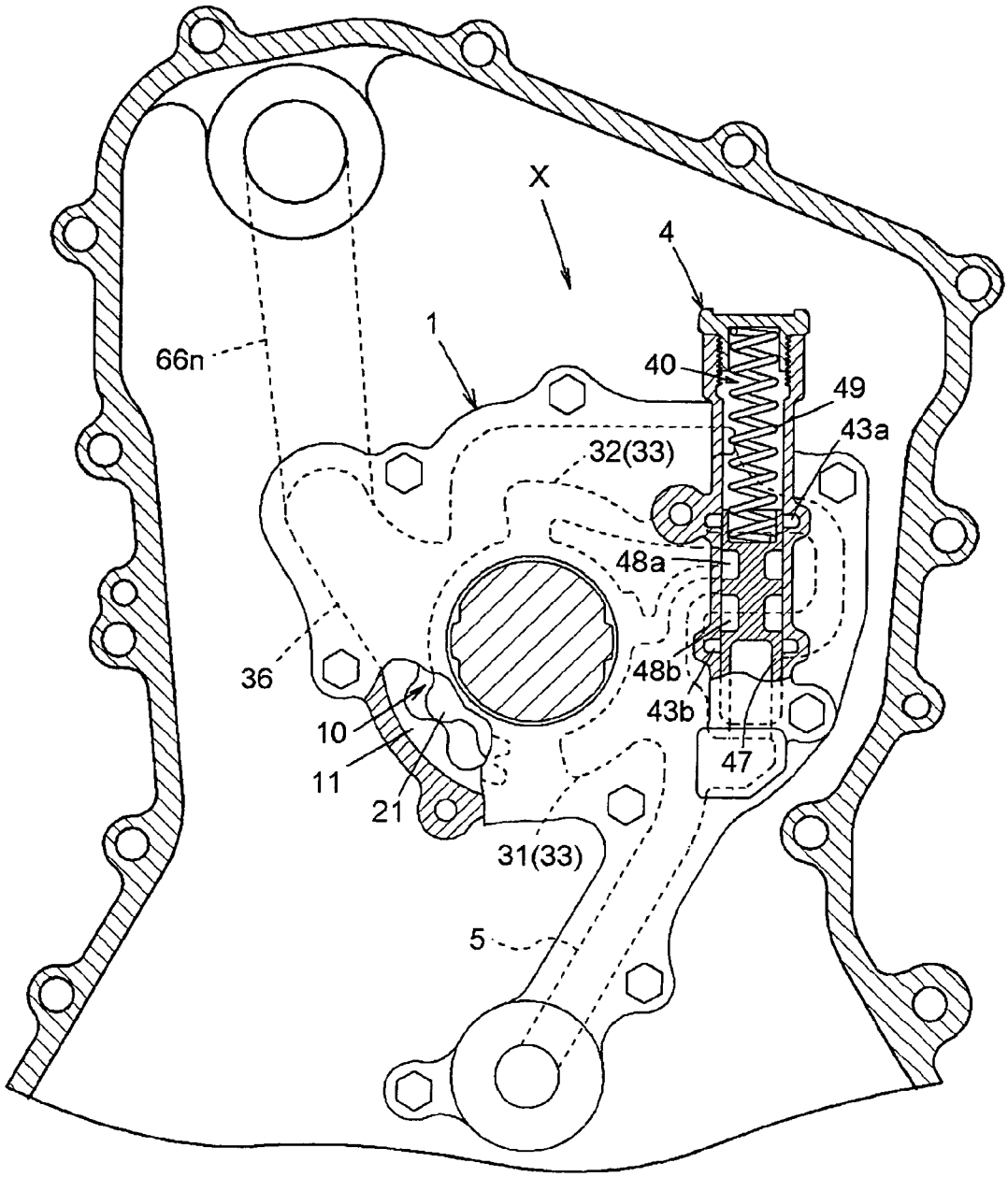
FIG. 2 is a schematic layout when an engine of the oil supply system of the present invention is mounted.

The present invention is described in further detail below with reference to an embodiment according to the accompanying drawings. This embodiment illustrates an oil supply system which generates hydraulic pressure by the rotation of a crankshaft in an internal combustion engine mounted in a vehicle. FIG. 1 is a conceptual arrangement of an oil supply system of this embodiment of the present invention. FIG. 2 is a schematic layout of the oil supply system of the present invention mounted in the engine.

As illustrated in FIGS. 1 and 2, the oil supply system X for the engine of the present invention is provided with a pump body 1 including an inlet port 36 suctioning a hydraulic oil in response to the rotation of a rotor 2 driven by synchronizing with a crankshaft, a first outlet port 31 discharging the hydraulic oil and a second outlet port 32 discharging the hydraulic oil therefrom. The oil supply system X for the engine is further provided with a hydraulic-oil-delivery passage 5 for delivering the hydraulic oil to a hydraulic-oil receiving unit 7, a first oil passage 61 for delivering the hydraulic oil discharged out of the first outlet port 31 to the hydraulic-oil-delivery passage 5 at least and a second oil passage 62 for delivering the hydraulic oil discharged out of the second outlet port 32 to the hydraulic-oil-delivery passage 5. Furthermore, the oil supply system for the engine is further provided with a return hydraulic passage 66 returning the hydraulic oil discharged out of a hydraulic-pressure control valve 4 including a valve 47 which is moved in response to hydraulic pressure of the hydraulic oil delivered to the hydraulic-oil-delivery passage 5, to at least either the inlet port 36 or a oil pan 69. Each member will be illustrated hereinbelow.

The pump body 1 according to the oil supply system X is made of metal, such as an aluminum-based alloy and an iron-based alloy. In the pump body 1, a pump chamber 10 is formed. In the pump chamber 10, an internal gear portion 12 having a plurality of inner gears 11 serving as a driven gear is formed.

In the pump chamber 10, the rotor 2 made of metal is rotatably disposed therein. The rotor 2 is connected to the crankshaft of the internal combustion engine which constitutes the driving force, and rotates with the crankshaft. The rotor 2 is designed to rotate at 600 rpm to 7000 rpm.

On an outer periphery of the rotor 2, an outer gear portion 22 having a plurality of external gears 21 serving as the drive gear is formed. The internal gears 11 and the external gears 21 are defined by such as a trochoid curve or a cycloidal curve. The rotor 2 rotates in a direction of an arrow "A1" as illustrated FIG. 1. The external gears 21 of the rotor 2 mesh with the internal gears 11 one after another in response to the rotation of the rotor 2. Accordingly the internal gears 12 rotates in the same direction. Spaces 22*a* through 22*k* are formed by the external gears 21 and the internal gears 11. In FIG. 1, the space 22*k* has the largest volume among the spaces 22*a* through 22*k*, and the space 22*e* and 22*f* have the smallest volume.

When spaces 22*e* through 22*a* go downstream, their volume is enlarged gradually as the rotor 2 rotates. An inlet pressure of the hydraulic oil is produced thereby and an inlet action of the hydraulic oil is obtained. In spaces 22*j* through 22*f*, the discharging pressure is produced since their volume is diminished gradually when the rotor 2 rotates.

In the pump body 1 of the oil pump, an outlet port group 33 is formed by the first outlet port 31 (i.e., a main outlet port) and the second outlet port 32 (i.e., a sub-outlet port). That is, the outlet port group 33 serves as discharging the hydraulic oil from the pump chamber 10 in response to the rotation of the rotor 2. The main outlet port 31 is provided with end sides 31*a* and 31*c*. The sub-outlet port 32 is provided with end sides 32*a* and 32*c*.

Further, in the pump body 1 of the oil pump, the inlet port 36 is formed as well. The inlet port 36 serves to suction the hydraulic oil into the pump body 10 in response to the rotation of the rotor 2. The inlet port 36 is provided with end sides 36*a* and 36*c*.

In this preferred embodiment, the main outlet port 31 is located at the downstream side relative to the sub-outlet port 32 in the rotary direction of the rotor 2 indicated by the arrow "A1". An open area of the main outlet port 31 is set to be larger than the open area of the sub-outlet port 32.

The main outlet port 31 and the sub-outlet port 32 are divided by a dividing portion 37. Thereby the main outlet port 31 and the sub-outlet port 32 have independent discharging-function respectively.

The width of the dividing portion 37 is set to be narrower than the width of space between inner and outer gears at the area between the main outlet port 31 and the sub-outlet port 32. Thus, the hydraulic pressure increase caused by blocking the space in the compression stage can be avoided.

The hydraulic-oil-delivery passage 5 is a hydraulic-oil passage delivering the hydraulic oil to the hydraulic-oil receiving unit 7. The hydraulic-oil receiving unit 7 may be a lubricating device such as a bearing, a valve operation mechanism for an internal combustion engine or a driving mechanism such as a cylinder and a piston of the internal combustion engine, which are required to supply the hydraulic oil.

The first oil passage 61 is the oil passage which connects the main outlet port 31 to the hydraulic-oil-delivery passage 5. That is, the first oil passage 61 has the function which delivers the hydraulic oil discharged out of the main outlet port 31 to the hydraulic-oil-delivery passage 5.

The second oil passage 62 is the oil passage which connects the sub-outlet port 32 to the hydraulic-oil-delivery passage 5. That is, the second oil passage 62 has the function which delivers the hydraulic oil discharged out of the sub-outlet port 32 to the hydraulic-oil-delivery passage 5.

FIG. 1 shows an example of the function that the hydraulic oil discharged out of the sub-outlet port 32 flows through the hydraulic-pressure control valve 4 and the main outlet port 31, then flows to the hydraulic-oil-delivery passage 5 via the first oil passage 61.

The return hydraulic passage 66 is an oil passage which returns the hydraulic oil discharged out of the hydraulic control valve 4 to any one of the inlet port 36 and an oil pan 69.

In addition, a passage 66*n* which suctions the hydraulic oil out of the oil pan 69 is disposed in communication with the inlet port 36.

The hydraulic-pressure control valve 4 is provided with a valve 47 which moves in response to the hydraulic pressure of the hydraulic oil delivered to the hydraulic-oil-delivery passage 5. The hydraulic control valve 4 is further provided with a valve chamber 40 in which the valve 47 is freely slidable. In the valve chamber 40, the valve 47 is disposed by biased by a spring 49 in the direction of the arrow "B1".

At both ends of the valve 47, a first valve portion 47*x* and a second valve portion 47*y* which compose a hydraulic-oil receiving portion 48 which receives the hydraulic oil within hydraulic-pressure control valve 4 are disposed. Further in the valve 47, a dividing body 47*a* which divides the hydraulic-oil receiving portion 48 into a first valve chamber 48*a* and a second valve chamber 48*b* is disposed.

In the hydraulic-pressure control valve 4, a first valve port 41, a second valve port 42, return ports 43*a* and 43*b* and a merging port 44 which communicate with each described oil passage are disposed.

The first valve port 41 communicates with the first oil passage 61 and the hydraulic-oil-delivery passage 5 via an intermediate oil passage 61*r*. The hydraulic pressure of the hydraulic oil can be transmitted to the valve 47 via the intermediate oil passage 61 thereby.

The second valve port 42 is capable of communicating with the second oil passage 62. The hydraulic oil discharged out of the second outlet port 32 can be discharged to the hydraulic-oil receiving portion 48 thereby.

The return ports 43*a* and 43*b* are capable of communicating with the return hydraulic passage 66. The hydraulic discharged out of the hydraulic control valve 4 can be returned to the inlet port 36 thereby.

The merging port 44 is capable of communicating with the main outlet port 31 so as to deliver the hydraulic oil discharged out of the hydraulic-pressure control valve 4 to the main outlet port 31.

In the oil supply system X for the engine of the present invention described above, the valve 47 of the hydraulic-pressure control valve 4 have five modes i.e., modes A through E, according to the rotational speed of the rotor 2 as described hereinbelow.

The mode "A" will be described with reference to FIG. 3. When the rotor 2 rotates at low speed (e.g., up to about 1500 rpm) immediately after the engine has just driven, the hydraulic oil is delivered to the hydraulic-oil-delivery passage 5 by the hydraulic pressure of the hydraulic oil of the first oil passage 61 discharged out of the outlet port group 33. This hydraulic pressure acts on the valve 47 via the intermediate oil passage 61*r* and the first valve port 41 of the hydraulic-pressure control valve 4. Valve driving force "F1" is generated thereby to drive the valve 47. When the valve driving force "F1" is smaller than biasing force "F3" of the spring 49 (i.e., F1>F3), the valve 47 moves in the direction of the arrow "B1" (see FIG. 1).

Under this condition, the first valve portion 47*x* of the valve 47 blocks the return port 43*a* and the second valve portion 47*y* of the valve 47 blocks the return port 43*b* respectively. Further the second valve port 42 is in communication with the merging port 44 as shown in FIG. 3. Thus the hydraulic oil discharged out of the sub-outlet port 32 can be delivered to the hydraulic-oil-delivery passage 5 via the first valve chamber 48*a*. That is, the hydraulic oil discharged out of the sub-outlet port 32 can be delivered to the hydraulic-oil-delivery passage 5 via the first valve chamber 48*a* when the hydraulic pressure delivered to the hydraulic-oil-delivery passage 5 is within a predetermined value.

According to the mode "A", a supply amount of the hydraulic oil delivering to the hydraulic-oil-delivery passage 5 is the total amount of the discharging amount of the main outlet port 31 and the discharging amount of the sub-outlet port 32. An oil amount delivered to the hydraulic-oil-delivery passage 5 has a characteristic performance as shown by a solid line O-P in FIG. 8. That is, the discharging amount of the hydraulic oil discharged out of the main outlet port 31 increases according to the increase of the rotational speed of the rotor 2. Further, the discharging amount of the hydraulic oil discharged out of the sub-outlet port 32 increases according to the increase of the hydraulic pressure in the first oil passage 61. The characteristic performance that the hydraulic pressure in the second oil passage 62 increases can be obtained.

Secondly, the mode "B" will be described with reference to FIG. 4. The rotational speed of the rotor 2 increases according to the increase of the rotational speed of the crankshaft of the internal combustion engine working as the driving power force. When the rotational speed of the rotor 2 exceeds the predetermined rotational speed (N1: e.g., 1500 rpm) i.e., at a first medium speed area, and the valve driving force "F1" overcomes the biasing force "F3" of the spring 49 (F1>F3), the valve 47 moves in the-direction of an arrow "B2" until the valve driving force "F1" and the urging force "F3" of the spring 49 balance (see FIG. 1).

Figure 4:
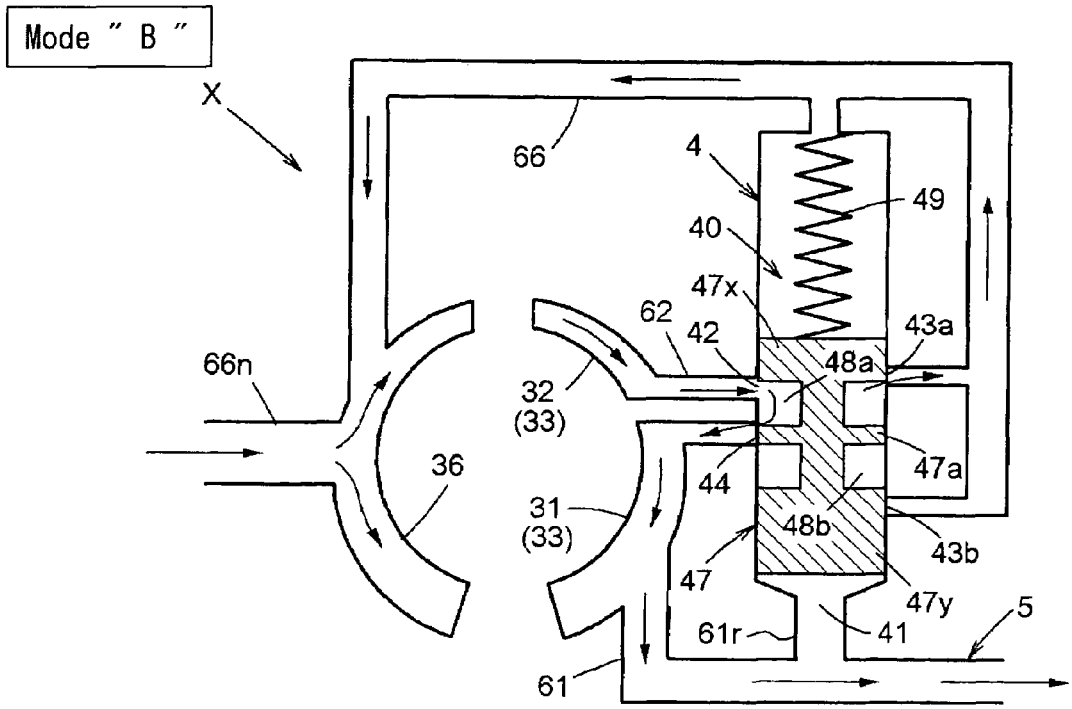
FIG. 4 is a schematic diagram of a main part of the oil supply system of the present invention in a case that a rotational speed of the rotor is in a first medium speed area (a mode "B")

As shown in FIG. 4, the condition that the second valve port 42 and the merging port 44 are in communication is maintained and the block of the return port 43*a* in the first valve portion 47*x* is released. That is, the mode "B" shows an intermediate mode wherein the valve 47 is shifting to the mode "C" described later. The hydraulic oil discharged out of the sub-outlet port 32 can be delivered to the return hydraulic passage 66 in part and the rest is delivered to the hydraulic-oil-delivery passage 5 via the first valve chamber 48*a*.

In the mode "B", the supply amount of the hydraulic oil delivered to the hydraulic-oil-delivery passage 5 is the total discharging amounts of the main outlet port 31 and the discharging amount of the sub-outlet port 32. The oil amount delivered to the hydraulic-oil-delivery passage 5 has a characteristic performance as indicated by a solid line P-Q in FIG. 8. Accordingly, a rate of the increase in the discharging amount relative to the increase of the rotational speed of the rotor reduces since a passage returning to the return hydraulic passage 66 communicates.

A relationship between a required oil amount of a variable valve timing control device working as the hydraulic-oil receiving unit 7 and the rotational speed of the rotor in the engine will be described hereinbelow. For example, immediately after the engine starts, the total discharged amount which adds the discharging amount of the sub-outlet port 32 to the discharging amount of the main outlet port 31 is required. However, when the rotational speed of the rotor exceeds the predetermined rotational speed (N1), the total discharged amount is not required. The required oil amount can be provided by the discharging amount of the main outlet port 31 only (i.e., an area shown by "V" in FIG. 8). Accordingly, it is preferable that the oil supply system X is composed so that each inclination of line O-P and line P-Q shown in FIG. 8 can exceed the required oil amount V required for the variable valve timing control device.

Thirdly, the mode "C" will be described with reference to the accompany drawings. When the rotational speed of the rotor further increases to the value N2 or to exceed the value N2 (e.g., 2500 rpm), the valve 47 further moves in the direction of the arrow "B2" (see FIG. 1).

Figure 5:
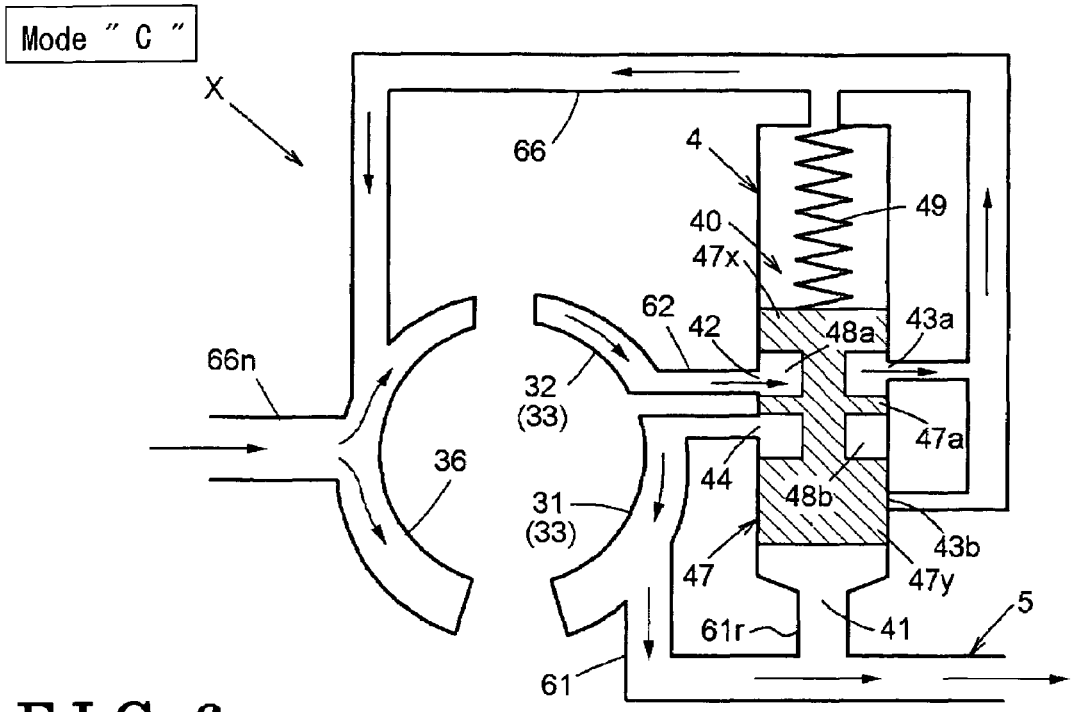
FIG. 5 is a schematic diagram of a main part of the oil supply system of the present invention in a case that the rotational speed of the rotor is in another first medium speed area (a mode "C")

As shown in FIG. 5, since the second valve port 42 does not communicate with the merging port 44. The block of the return port 43*a* in the first valve portion 47*x* of the valve 47 is fully released.

That is, when the hydraulic pressure of the hydraulic oil flowing to the hydraulic-oil-delivery passage 5 exceeds the predetermined value, the hydraulic oil discharged out of the main outlet port 31 is delivered to the hydraulic-oil-delivery passage 5. The hydraulic oil discharged out of the sub-outlet port 32 can be delivered to the return hydraulic passage 66 via the first valve chamber 48*a*.

Figure 8:
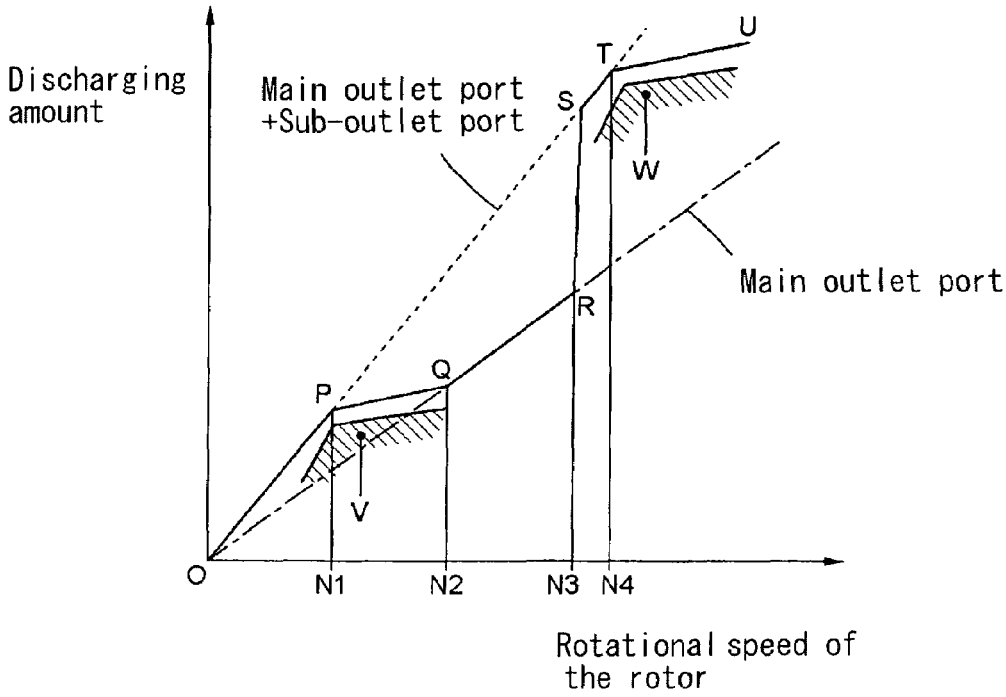
FIG. 8 is a graph showing a relationship between the rotational speed of the rotor in the engine and a discharging amount of a hydraulic oil in an outlet port group.
Figure 9:
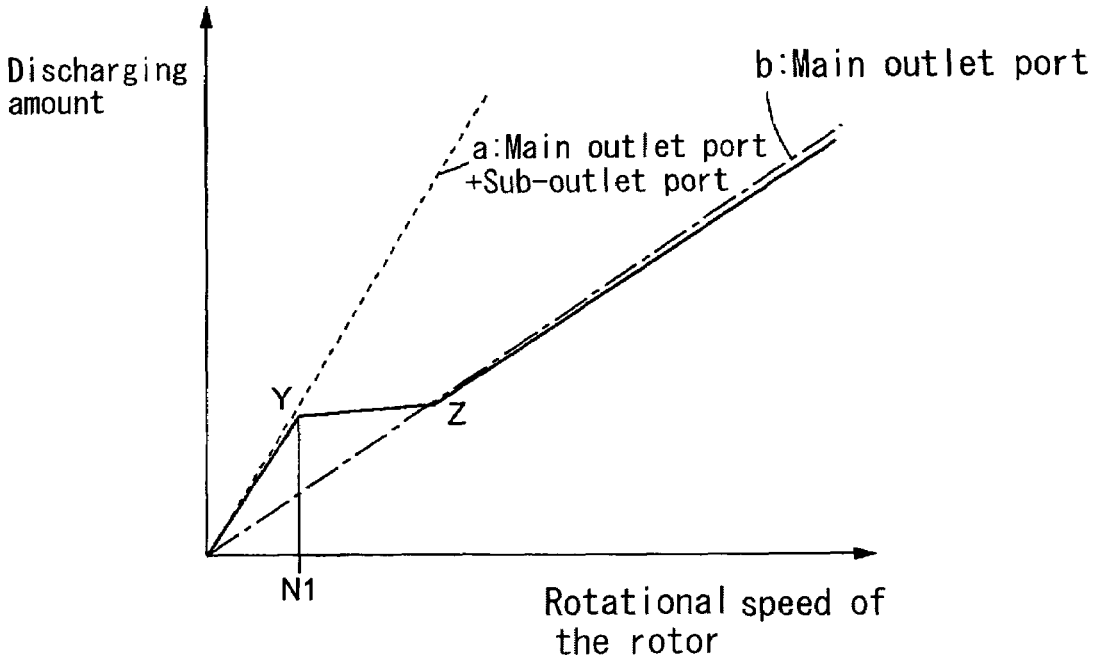
FIG. 9 is a graph showing a relationship between the rotational speed of the rotor in the engine and the discharging amount of the hydraulic oil in conventional oil supply systems.

The oil amount delivered to the hydraulic-oil-delivery passage 5 has a characteristic performance as indicated by a solid line Q-R in FIG. 8. That is, in the mode "C", the oil amount delivered to the hydraulic-oil-delivery passage 5 is equal to the oil amount discharged out of the main outlet port 31.

Fourth, the mode "D" will be described with reference to the accompany drawings. When the rotational speed of the rotor further increases to the value N3 or to exceed the value N3 i.e., a second medium speed area (e.g., 4000 rpm), the valve 47 further moves in the direction of the arrow "B2" (see FIG. 1).

Figure 6:
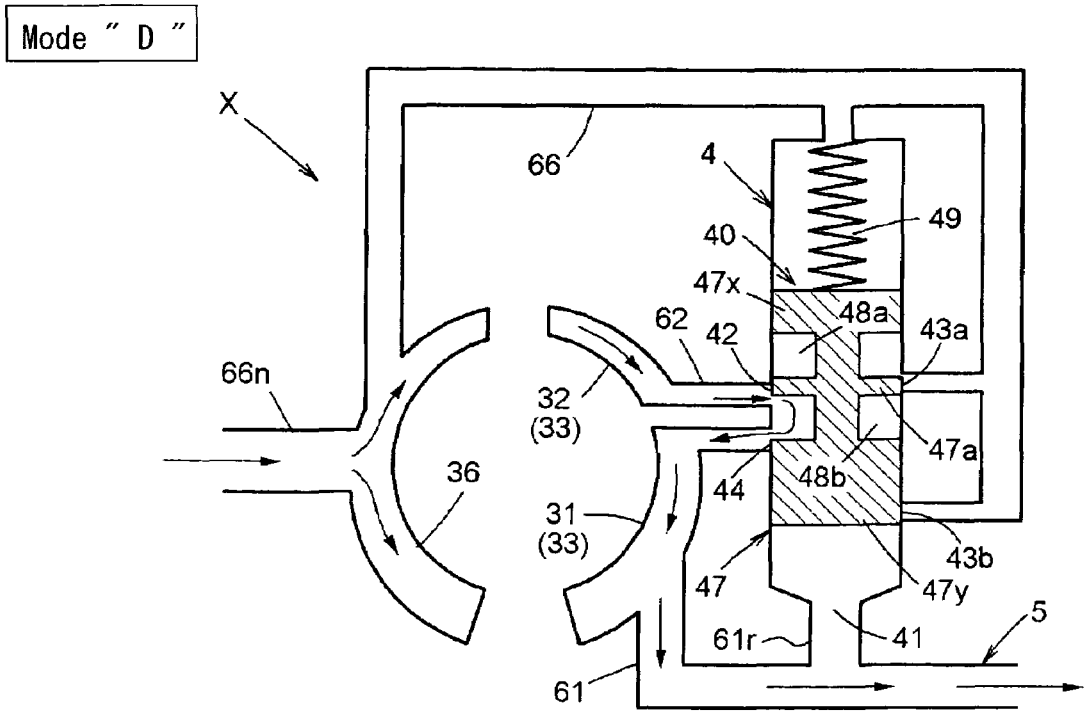
FIG. 6 is a schematic diagram of a main part of the oil supply system of the present invention in a case that the rotational speed of the rotor is in a second medium speed area (a mode "D")

As shown in FIG. 6, the second valve port 42 communicates with the merging port 44 and the dividing chamber 47*a* prevents the hydraulic oil from moving to the return port 43*a*. Accordingly, the hydraulic oil discharged out of the sub-outlet port 32 can be delivered to the hydraulic-oil-delivery passage 5 via the second valve chamber 48*b*.

Under the condition that the hydraulic pressure of the hydraulic oil acting on the hydraulic-oil-delivery passage 5 exceeds the predetermined value, the hydraulic oil discharged out of the sub-outlet port 32 can be delivered to the hydraulic-oil-delivery passage 5 via the second valve chamber 48*b*.

Therefore, in the mode "D", the supply amount of the hydraulic oil delivered to the hydraulic-oil-delivery passage 5 is the total amount of the discharging amounts discharged out of the main outlet port 31 and the sub-outlet port 32.

The oil amount delivered to the hydraulic-oil-delivery passage 5 has a characteristic performance as indicated by a solid line R-T in FIG. 8. After the second valve port 42 communicates with the merging port 44, the hydraulic oil delivered to stops flowing to the return port 43*a*. For that reason, the flowing route of the hydraulic oil delivered to the return port 43*a* is changed to the hydraulic-oil-delivery passage 5. Therefore, the supply amount delivered to the hydraulic-oil-delivery passage 5 increases (see a solid line R-S in FIG. 8) and becomes the total amount of the discharging amounts discharged out of the main outlet port 31 and the sub-outlet port 32 (i.e., a solid line S-T in FIG. 8).

Lastly, the mode "E will be described with reference to the accompany drawings. When the rotational speed of the rotor further increases to the value N4 or to exceed the value N4 i.e., a high-speed area (e.g., 4500 rpm), the valve 47 further moves in the direction of the arrow "B2" (see FIG. 1).

Figure 7:
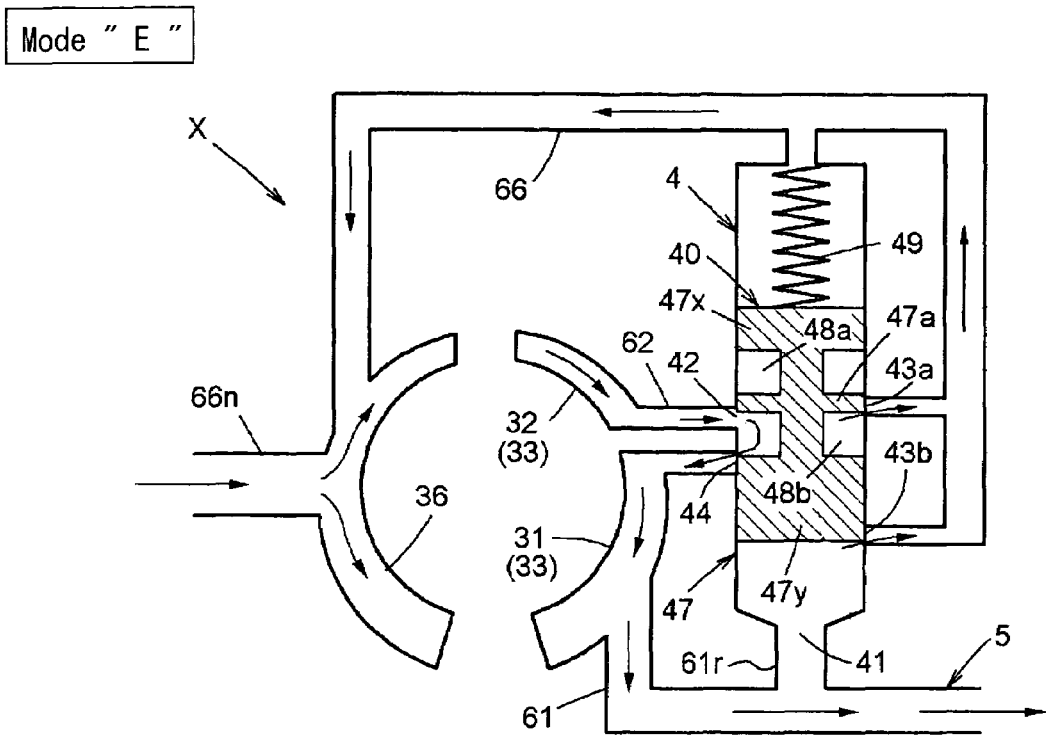
FIG. 7 is a schematic diagram of a main part of the oil supply system of the present invention in a case that the rotational speed of the rotor is in a high speed area (a mode "E")

As shown in FIG. 7, the condition that the second valve port 42 and the merging port 44 are in communication with each other is maintained and the block of the return port 43*b* by the second valve portion 47*y* is released. Next, the block of the return port 43*a* by the dividing portion 47*a* is released. By this release, the hydraulic oil discharged out of the sub-outlet port 32 can be delivered to the return hydraulic passage 66 via the second valve chamber 48*b* and the return port 43*a* and the hydraulic oil discharged out of the main outlet port 31 can be delivered to the return hydraulic passage 66 via the return port 43*b*.

Therefore, in the mode "E", the total amount is a part of the discharging amount of the main outlet port 31 and a part of the discharging amount of the sub-outlet port 32.

The oil amount delivered to the hydraulic-oil-delivery passage 5 has a characteristic performance as indicated by a solid line T-U in FIG. 8. Thus, the rate of the increase in the discharging amount relative to the increase of the rotational speed of the rotor reduces since the passages returning to the return hydraulic passage 66 are in open communication.

A relationship between the required oil amount of a jet for a piston operating as the hydraulic-oil receiving unit 7 and the rotational speed of the rotor will be described hereinbelow. For example, the total discharging amount of the discharging amount of the main outlet port 31 and the sub-outlet port 32 is required around the high-speed area in the rotation of the rotor. However, when the rotational speed of the rotor exceeds the predetermined rotational speed (N4) of the rotor, the total discharging amount is not required (i.e., an area shown by "W" in FIG. 8). Accordingly, it is preferable that the oil supply system X is composed so that the inclination of the line T-U shown in FIG. 8 can exceed the required oil amount "W" of the jet for the piston.

There are summarized as follow. When the hydraulic pressure of the hydraulic oil working to the hydraulic-oil-delivery passage 5 is in the predetermined value, the hydraulic oil discharged out of the sub-outlet port 32 can be delivered to the hydraulic-oil-delivery passage 5 via the first valve chamber 48*a*. The supply amount of hydraulic oil delivered to the hydraulic-oil-delivery passage 5 is the amount wherein the discharging amount discharged out of the main outlet port 31 and the discharging amount discharged out of the sub-outlet port 32 are added (i.e., the solid line O-P shown in FIG. 8).

When the rotational speed of the internal combustion engine and the rotational speed of the rotor increase, and the hydraulic pressure of the hydraulic oil discharged out of the main outlet port 31 exceeds the predetermined value, the required hydraulic pressure working to the hydraulic-oil-delivery passage 5 is secured up by the hydraulic oil discharged out of the main outlet port 31 only. In this case, it is not required that the hydraulic oil discharged out of the first oil passage 61 and the hydraulic oil discharged out of the second oil passage 62 are added (i.e., two lines P-Q and Q-R shown in FIG. 8).

When the required hydraulic pressure is secured up in the first oil passage 61 only, the required hydraulic pressure is returned to the return oil hydraulic passage 66 without delivering the extra hydraulic oil in the second oil passage 62 to the hydraulic-oil-delivery passage 5. The high hydraulic pressure does not affect the extra hydraulic oil.

On the other hand, when the rotational speed of the rotor is in the high-speed area, the hydraulic oil is required to supply to a lot of pistons immediately. For that purpose, when the hydraulic pressure of the hydraulic oil working to the hydraulic-oil-delivery passage 5 exceeds the predetermined value in the present invention, the oil supply system X is composed so that the hydraulic oil discharged out of the sub-outlet port 32 can be delivered to the hydraulic-oil-delivery passage 5 via the second valve chamber 48*b*. The supply amount of the hydraulic oil delivering to the hydraulic-oil-delivery passage 5 is the added amount of the discharging amount of the main outlet port 31 and the discharging amount of the sub-outlet port 32 (i.e., a solid line S-T shown in FIG. 8).

Accordingly, even when the rotational speed of the rotor is in the high-speed area, the required oil amount for delivering is steadily secured since the volume of the hydraulic oil capable of delivering increases again.

In the embodiment described above, a moving-direction dimension L1 of the first valve chamber 48*a* and a moving-direction dimension L2 of the second valve chamber 48*b* are designed as follows.

A design method of the moving-direction dimension L1 of the first valve chamber 48*a* will be illustrated by an example.

Figure 3:
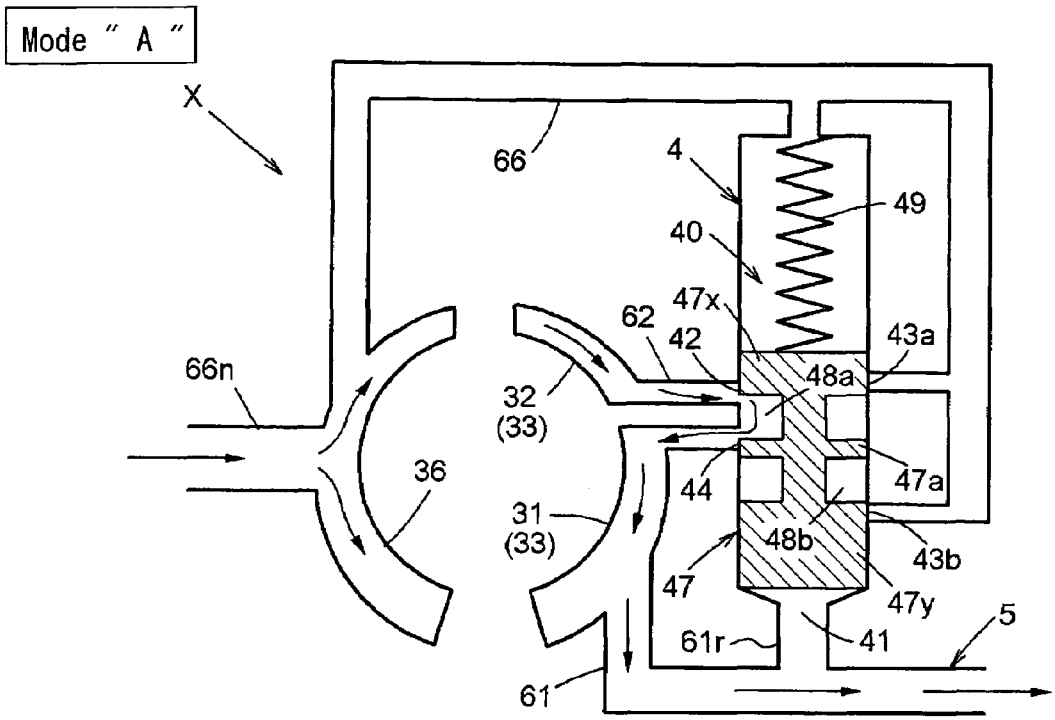
FIG. 3 is a substantial-part schematic diagram of the oil supply system of the present invention in a case that a rotational speed of the rotor is in a low speed area (a mode "A")

When the first valve chamber 48*a* communicates with the second oil passage 62 in FIG. 3, the second valve port 42 communicates with the merging port 44. That is, the first valve chamber 48*a* communicates with the first outlet port 31. The oil supply system X is composed so as to keep the return port 43*a* closing.

In FIG. 4, the second valve port 42 communicates with the merging port 44, and the return port 43*a* is secured closing by slidably moving of the valve 47 in the valve chamber 40. That is, the first valve chamber 48*a* is composed so as to communicate with the return hydraulic passage 66.

Accordingly, when the first valve chamber 48*a* communicates with the second oil passage 62, the first valve chamber 48*a* is composed so as to communicate with at least either first outlet port 31 or return hydraulic passage 66.

On the other hand, a design method of the moving-direction dimension L2 of the second valve chamber 48*b* will be illustrated by an example.

When the valve 47 further slides the valve chamber 40 relative to the mode illustrated in FIG. 5, the merging port 44 starts communicating with the second valve port 42 at just an under surface of the dividing chamber 47*a* defining an under surface of the first valve chamber 48*a* and an upper surface of the second valve chamber 48*b*, i.e., the second calve chest 48*b*.

In FIG. 6, when the second valve chamber 48*b* communicates with the second oil passage 62, the merging port 44 communicates with the second valve port 42. That is, the second valve chamber 48*b* communicates with the first outlet port 31. The oil supply system X is composed so as to keep the return port 43*a* closing.

In FIG. 7, the second valve port 42 communicates with the merging port 44, and the return port 43*a* is secured closing. That is, the second valve chamber 48*b* is composed so as to communicate with the return hydraulic passage 66.

Accordingly, when the second valve chamber 48*b* communicates with the second oil passage 62, the second valve chamber 48*b* is composed so as to communicate with at least either first outlet port 31 or return hydraulic passage 66.

For that purpose, the moving-direction dimension L1 of the first valve chamber 48*a* and the moving-direction dimension L2 of the second valve chamber 48*b* require a relationship of an accurate dimension.

When such relationship of the accurate dimension is obtained, the pressure of the second outlet port 32 excessively increases by closing of the second oil passage. Thereby, some inconvenience such as increase of driving horsepower and damage of the pump body raises. However, in this composition, the required oil amount can be delivered to the hydraulic-oil receiving unit 7 without exceeding of the hydraulic pressure.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby,

The invention claimed is:

1. An oil supply system for an engine comprising:

a pump body including an inlet port for suctioning a hydraulic oil in response to the rotation of a rotor driven by synchronizing with a crankshaft, a first outlet port for discharging the hydraulic oil and a second outlet port for discharging the hydraulic oil in response to the rotation of the rotor;

a hydraulic-oil-delivery passage for delivering the hydraulic oil to a hydraulic-oil receiving unit;

a first oil passage for delivering the hydraulic oil discharged out of the first outlet port to the hydraulic-oil-delivery passage;

a second oil passage for delivering the hydraulic oil discharged out of the second outlet port to the hydraulic-oil-delivery passage; and a return hydraulic passage for returning the hydraulic oil discharged out of a hydraulic-pressure control valve including a valve body which is moved in response to the hydraulic pressure delivered to the hydraulic-oil-delivery passage, to at least either the inlet port or an oil pan, wherein the valve body divides a hydraulic-oil receiving portion for receiving the hydraulic oil in the hydraulic-pressure control valve into a first valve chamber and a second valve chamber, and when the hydraulic pressure oil delivered to the hydraulic-oil-delivery passage is in a predetermined value, the hydraulic oil discharged out of the second outlet port is delivered to the hydraulic-oil-delivery passage via the first valve chamber, and further when the hydraulic pressure delivered to the hydraulic-oil-delivery passage exceeds the predetermined value, the hydraulic oil discharged out of the second outlet port is delivered to the hydraulic-oil-delivery passage via the second valve chamber.

2. An oil supply system for an engine according to claim 1, wherein the first valve chamber and second valve chamber that communicate with at least either first outlet port or the return oil passage when the first valve chamber and the second valve chamber communicate with the second oil passage.

3. An oil supply system for an engine according to claim 1, wherein the first outlet port and the second outlet port are divided by a dividing portion, the width of the dividing portion is set to be narrower than the width of space between inner and outer gears at the area between the first outlet port and the second outlet port.

4. An oil supply system for an engine according to claim 2, wherein the first outlet port and the second outlet port are divided by a dividing portion, the width of the dividing portion is set to be narrower than the width of space between inner and outer gears at the area between the first outlet port and the second outlet port.

5. An oil supply system for an engine according to claim 1, wherein the first valve chamber is composed so as to communicate with at least either first outlet port and return oil passage when the first valve chamber communicates with the second oil passage.

6. An oil supply system for an engine according to claim 3, wherein the first valve chamber is composed so as to communicate with at least either first outlet port and return oil passage when the first valve chamber communicates with the second oil passage.

7. An oil supply system for an engine according to claim 4, wherein the first valve chamber is composed so as to communicate with at least either first outlet port and return oil passage when the first valve chamber communicates with the second oil passage.

8. An oil supply system for an engine according to claim 1, wherein the second valve chamber is composed so as to communicate with at least either first outlet port and return oil passage when the second valve chamber communicates with the second oil passage.

9. An oil supply system for an engine according to claim 3, wherein the second valve chamber is composed so as to communicate with at least either first outlet port and return oil passage when the second valve chamber communicates with the second oil passage.

10. An oil supply system for an engine according to claim 4, wherein the second valve chamber is composed so as to communicate with at least either first outlet port and return oil passage when the second valve chamber communicates with the second oil passage.

* * * * *